US007872562B2

(12) United States Patent
Meinke et al.

(10) Patent No.: US 7,872,562 B2
(45) Date of Patent: Jan. 18, 2011

(54) MAGNETIC COIL CAPABLE OF SIMULTANEOUSLY PROVIDING MULTIPLE MULTIPOLE ORDERS WITH AN IMPROVED TRANSFER FUNCTION

(75) Inventors: Rainer Meinke, Melbourne, FL (US); Carl Goodzeit, Desoto, TX (US)

(73) Assignee: Advanced Magnet Lab, Inc., Palm Bay, FL (US)

( * ) Notice: Subject to any disclaimer, the term of this patent is extended or adjusted under 35 U.S.C. 154(b) by 44 days.

(21) Appl. No.: 12/473,549

(22) Filed: May 28, 2009

(65) Prior Publication Data

US 2010/0031496 A1 Feb. 11, 2010

(51) Int. Cl.
*H01F 27/28* (2006.01)
*G06G 7/16* (2006.01)

(52) U.S. Cl. ..... 336/225; 708/845

(58) Field of Classification Search ..... 708/801, 708/845, 800; 336/225, 170, 222
See application file for complete search history.

(56) References Cited

U.S. PATENT DOCUMENTS

| | | | |
|---|---|---|---|
| 3,197,680 | A | 7/1965 | Wingerson |
| 3,761,752 | A | 9/1973 | Anderson |
| 4,283,687 | A | 8/1981 | Madey |
| 4,639,708 | A | 1/1987 | Weatherly |
| 2003/0184427 | A1 | 10/2003 | Gavrilin |

FOREIGN PATENT DOCUMENTS

| | | |
|---|---|---|
| CA | 968398 | 5/1975 |
| EP | 0353153 | 1/1990 |
| EP | 0954009 A | 11/1999 |
| FR | 2550026 A | 2/1985 |

OTHER PUBLICATIONS

Ball, MJ et al, Modulated Double Helix Quadrupole Magnets, IEEE Transactions on Applied Superconductivity, IEEE Service Center Los Alamitos CA, US vol. 13, No. 2—Jun. 1, 2003, pp. 1369-1372.
Ball, MJ et al, "The Double Helix dipole- a novel approach to Accelerator Magnet Design" IEEE Transactions on Applied Superconductivity, IEEE Service Center Los Alamitos, CA, US, vol. 13, No. 2—Jun. 1, 2003, pp. 1365-1368.

*Primary Examiner*—Anh T Mai
(74) *Attorney, Agent, or Firm*—Ferdinand M. Romano; Beusse, Wolter, Sanks, Mora & Maire, P.A.

(57) ABSTRACT

A method for constructing a conductor assembly of the type formed of one or more coil rows which, when conducting current, generate a magnetic field or in which, in the presence of a changing magnetic field, a voltage is induced. In one embodiment comprises forming a conductor pattern in a first coil row according to the relationship $$X(\theta)=[h/(2*\pi)]\theta+\Sigma A_n \sin(n\theta+\phi_n)$$

$$Y(\theta)=R\cos(\theta)$$

$$Z(\theta)=R\sin(\theta),$$

the first coil row pattern suitable for simultaneously generating at least two multipole orthogonal field components of different orders, wherein:

X is measurable along an X axis, Y is measurable along a Y axis and Z is measurable along a Z axis, the coil row extends along the X axis, the coil row is formed with a conductor configured in a series of turns about the X axis creating spaced-apart segments of the conductor such that, along first portions of the segments, individual segments are relatively straight and along second portions of the segments the segments follow a contour having a definable radius of curvature, the series of turns providing a geometrical configuration for generating a first multipole component of order n=i with $A_n=A_i$ and $\phi_n=\phi_i$ and a second multipole component of order n=j with $A_n=A_j$ and $\phi_n=\phi_j$ with $\phi_i$ not equal to $\phi_j$.

8 Claims, 4 Drawing Sheets

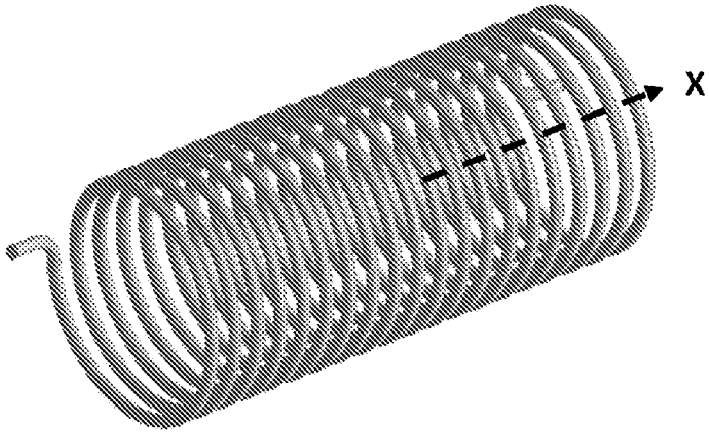
Figure 1A: (Prior Art)
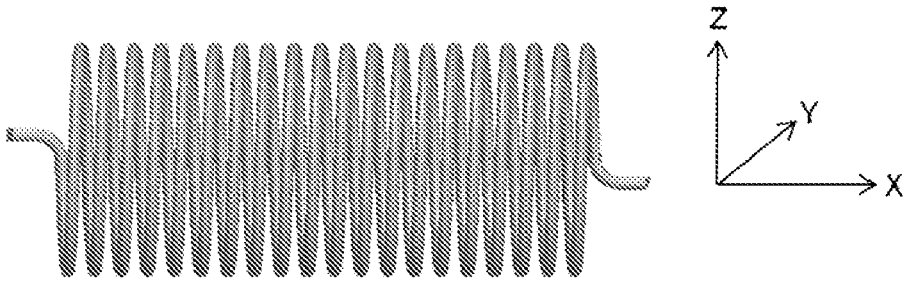
Figure 1B: (Prior Art)
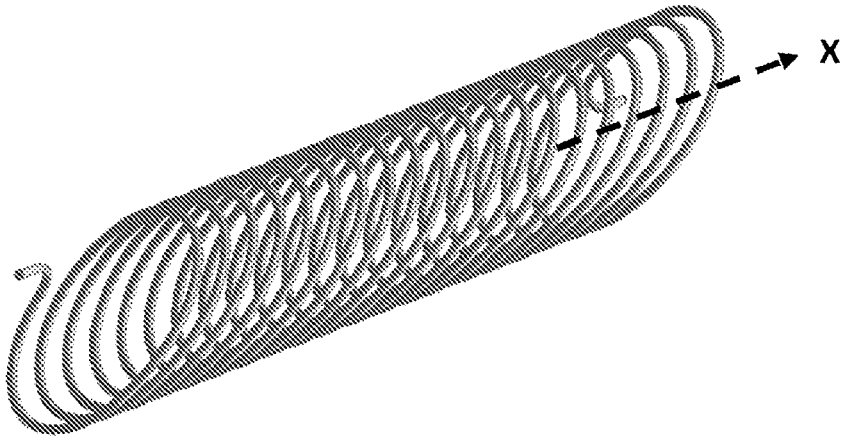
Figure 2: (Prior Art)

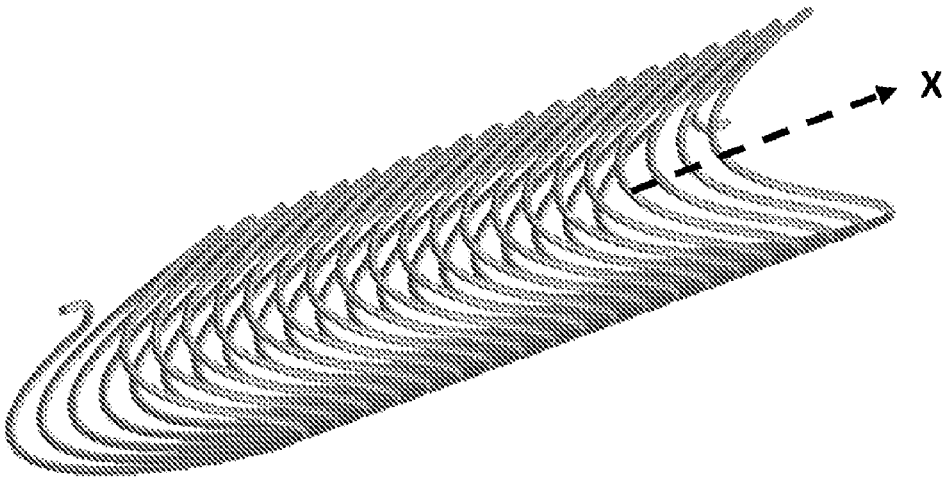
Figure 3: (Prior Art)
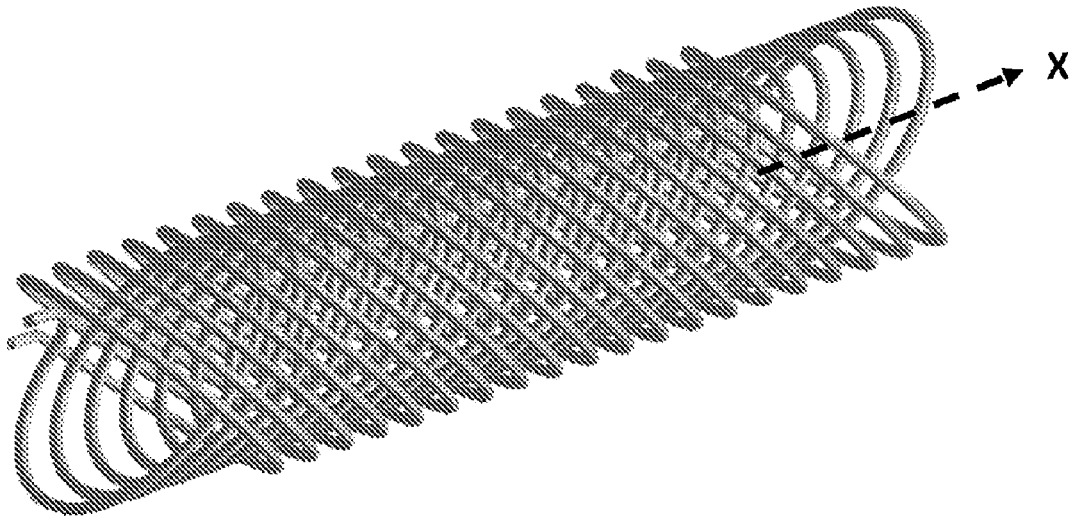
Figure 4: (Prior Art)

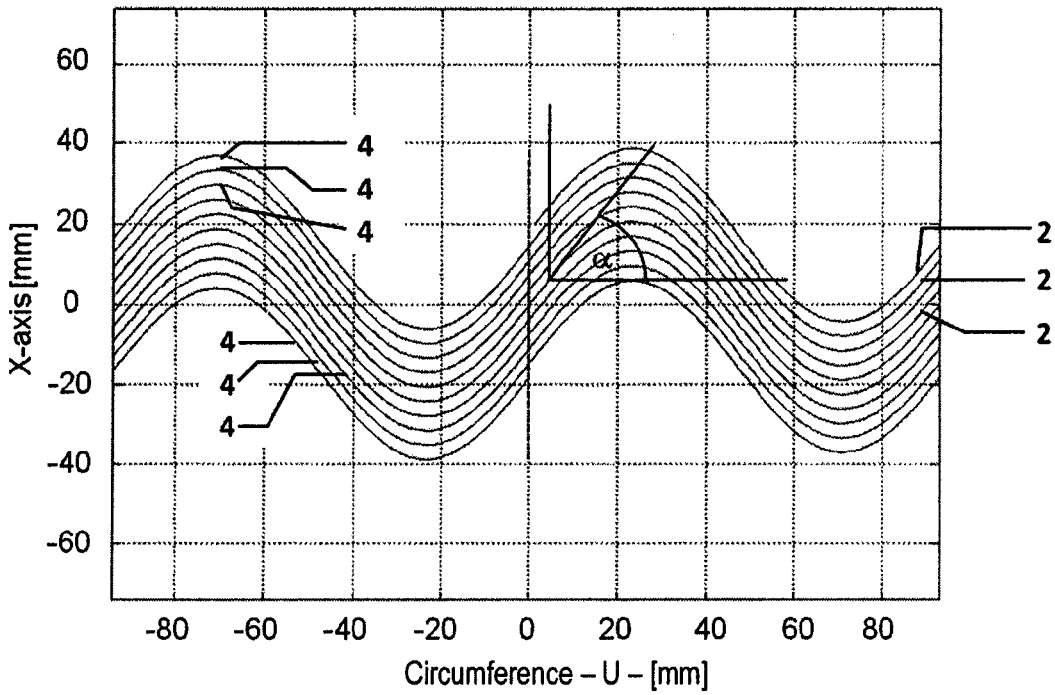
Figure 5: (Prior Art)
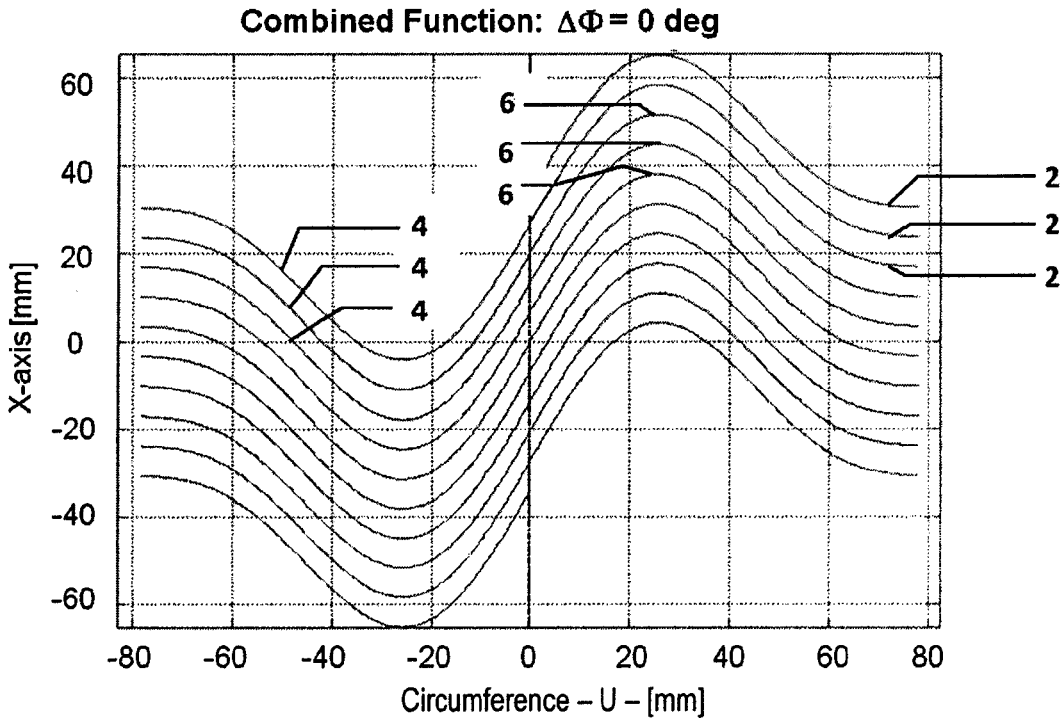
Figure 6: (Prior Art)

MAGNETIC COIL CAPABLE OF SIMULTANEOUSLY PROVIDING MULTIPLE MULTIPOLE ORDERS WITH AN IMPROVED TRANSFER FUNCTION

FIELD OF THE INVENTION

This invention relates to electromagnetic systems which generate magnetic fields. More particularly, the invention relates to systems of the type including conductor assemblies which, when conducting current, generate a magnetic field or which, in the presence of a changing magnetic field, generate or transform voltages.

It is of continued importance across many sectors of the world economy (e.g., R&D, and medical applications) to achieve improved performance in magnetic conductor assemblies. Development of new and improved commercial applications is dependent on an ability to create large and uniform magnetic fields. Advancements are also needed in numerous performance and reliability factors to realize commercially useful embodiments in medical, industrial and commercial applications. For example, it is desirable to make charged particle therapy cancer treatment (e.g., proton and carbon therapy) more available to patients, but these systems require cyclotrons and very large magnets to steer beams of high energy charged particles. System size and cost severely limit the availability of these applications. Currently, the gantries used for proton therapy treatment rooms may extend multiple stories in height and weigh over one hundred tons. One impediment to further deployment of these and other charged particle beam systems is the size and cost of the beam acceleration and focusing equipment.

In the long term, for charged particle therapy and certain other high magnetic field applications, it is likely that superconducting magnets will be preferred over resistive magnets. Generally, superconducting magnets offer very stable and high field strengths and can be substantially smaller in size than resistive magnets. Moreover, the power demands of superconducting magnets are very low. However, the opportunity to provide superconducting magnets in new applications may be compromised because of the well-known quenching phenomenon. When the superconducting material undergoes an unexpected and rapid transition to a normal, non-superconducting state this can result in rapid formation of a high temperature hot spot which can destroy a magnet. Designs which improve reliability have been costly. Cost is a major constraint to greater commercialization of conventional superconducting magnet technologies which rely on saddle or racetrack coils. Moreover, for a given set of operating conditions, significant design efforts must be employed to achieve requirements of field uniformity and to assure that quenching does not occur during normal system use.

Whether future systems employ resistive or superconductive windings, a need will remain to improve design efficiency, reliability and field quality. In order to deploy carbon-based systems for charged particle cancer treatment, the use of superconducting magnets may be imperative in order to meet the bending requirements of the high energy carbon beam. Coil segments used to bend beams are very complex and must be very stable in order to implement a curved trajectory. Further, it is very difficult to apply conventional geometries, e.g., saddle coil and race track configurations, to curvilinear applications and still meet requirements for field configurations.

At the same time, it is necessary to provide these systems at lower costs in order to encourage wider uses that benefit society. By way of illustration, mechanical structures required to assure stabilization of conductor windings in the presence of large fields are effective, but they are also a significant factor in overall weight and system cost. There is a continuing need to build magnet systems which are more efficient, more robust and more reliable. As one example, with rotating machinery being subject to wear under conditions of continued use, there are needs to provide costly maintenance and repair. Design improvements which substantially reduce these life cycle costs and the overall affordability of high field systems can accelerate deployment of useful systems that require generation of large magnetic fields. As another example, as magnets become capable of generating more complex combinations of fields, there is a need to improve the transfer function

SUMMARY OF THE INVENTION

According to an embodiment of the invention there is provided a method for constructing a conductor assembly of the type formed of one or more coil rows which, when conducting current, generate a magnetic field or in which, in the presence of a changing magnetic field, a voltage is induced. The method includes forming a conductor pattern in a first coil row according to the relationship $$X(\theta)=[h/(2*\pi)]\theta+\Sigma A_n\sin(n\theta+\phi_n)$$

$$Y(\theta)=R\cos(\theta)$$

$$Z(\theta)=R\sin(\theta).$$

The first coil row pattern is suitable for simultaneously generating at least two multipole orthogonal field components of different orders, wherein the coil row is formed with a conductor configured in a series of turns about the X axis, creating spaced-apart segments of the conductor. Along first portions of the segments, individual segments are relatively straight and along second portions of the segments the segments follow a contour having a definable radius of curvature. The series of turns provide a geometrical configuration for generating a first multipole component of order n=i with $A_n=A_i$ and $\phi_n=\phi_i$ and a second multipole component of order n=j with $A_n=A_j$ and $\phi_n=\phi_j$ with $\phi_i$ not equal to $\phi_j$.

An associated wiring assembly fabricated according to this method includes a first coil row having a conductor pattern according to the relationship $$X(\theta)=[h/(2*\pi)]\theta+\Sigma A_n\sin(n\theta+\phi_n)$$

$$Y(\theta)=R\cos(\theta)$$

$$Z(\theta)=R\sin(\theta).$$

The first coil row pattern is suitable for simultaneously generating at least two multipole orthogonal field components of different orders. The coil row is formed with a conductor configured in a series of turns about the X axis creating spaced-apart segments of the conductor such that, along first portions of the segments, individual segments are relatively straight and along second portions of the segments the segments follow a contour having a definable radius of curvature. The series of turns provide a geometrical configuration for generating a first multipole component of order n=i with $A_n=A_i$ and $\phi_n=\phi_i$ and a second multipole component of order n=j with $A_n=A_j$ and $\phi_n=\phi_j$ with $\phi_i$ not equal to $\phi_j$.

BRIEF DESCRIPTION OF THE FIGURES

FIGS. 1A and 1B are, respectively, perspective and elevation views of three-dimensional space curves illustrating a simple prior art spiral pattern;

FIG. 2 is a perspective view of a prior art coil having a regular helical geometry as used to form prior art double helix coil pairs suitable for generating a dipole field;

FIG. 3 is a perspective view of a prior art coil pattern used to form prior art double helix coil pairs suitable for generating a quadrupole field;

FIG. 4 is a perspective view of a prior art coil pair wherein the two coil patterns have opposite tilt angles relative to a plane;

FIG. 5 is an unrolled view of the quadrupole coil pattern shown in FIG. 3;

FIG. 6 is an unrolled view of a wiring pattern comprising multiple multipole components according to the prior art.

DETAILED DESCRIPTION OF THE INVENTION

Figure 7:
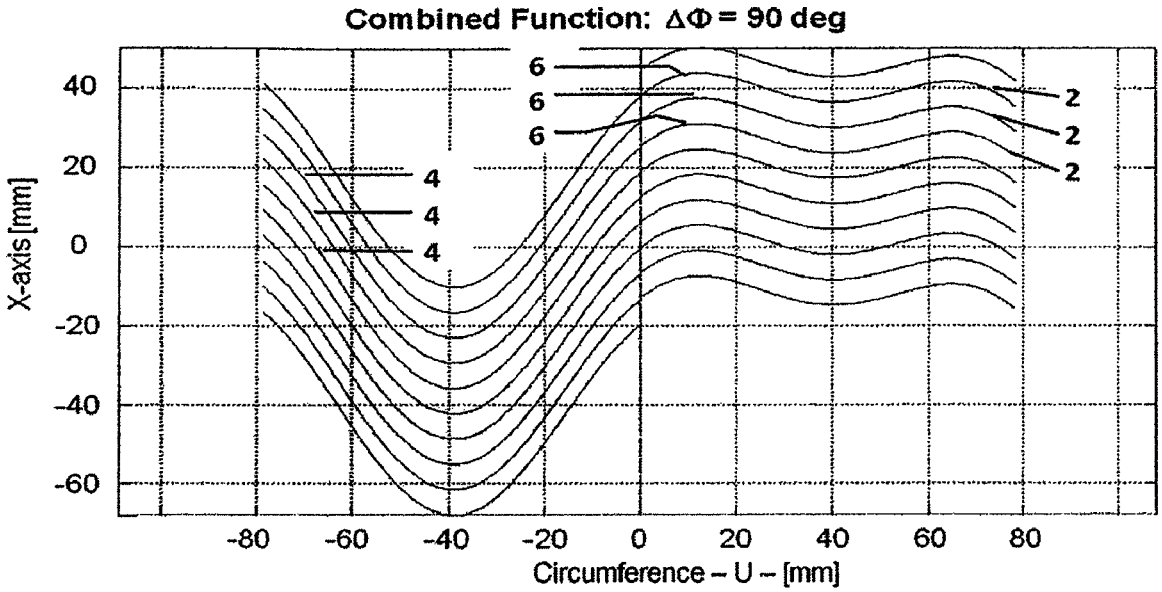
FIG. 7 is an unrolled view of a wiring pattern comprising multiple multipole components according to an embodiment of the invention.

Before describing in detail the particular methods and apparatuses related to embodiments of the invention, it is noted that the present invention resides primarily in a novel and non-obvious combination of components and process steps. So as not to obscure the disclosure with details that will be readily apparent to those skilled in the art, certain conventional components and steps have been omitted or presented with lesser detail, while the drawings and the specification describe in greater detail other elements and steps pertinent to understanding the invention. Further, the following embodiments do not define limits as to structure or method according to the invention, but provide examples which include features that are permissive rather than mandatory and illustrative rather than exhaustive.

As used herein, the terms coil, spiral and helix include but are not limited to regular geometric patterns. In addition, the terms coil, spiral and helix include configurations wherein a width (e.g., along the axial direction) or a thickness (e.g., along a radial direction or transverse to the axial direction) may vary. Contemplated embodiments include variations which depart substantially from regular geometries and which therefore may not be simply described in closed form. Numerical solutions, proximate as they may be, can be applied to model and design wiring configurations which may then be constructed accordingly to a desired level of precision. Further, terms such as winding, helical winding, wiring pattern and coil configuration as applied to physical embodiments formed of various conductor and/or insulative materials, are used without regard to how the materials are formed in place. That is, although it is conventional to physically wind a strand of conductor in the configuration of a spiral, the foregoing terms as used herein refer to the resulting configuration and not the methodology used to form the pattern. So, for example, a coil or winding may be formed from a cylindrical body by removal of body material, this resulting in a shape that corresponds to a spiral winding. In addition, the void resulting from the removal of material may also correspond to a spiral shape.

With coils helically-wound about an axis to produce magnetic field components transverse to the axis, cancellation of axial field components can be effected by the formation coils in concentrically positioned pairs having opposite tilt angles, this sometimes resulting in a high quality transverse field, e.g., a uniform dipole with essentially no higher order components. See, for example, Goodzeit et al., "The Double-Helix Dipole—A Novel Approach to Accelerator Magnet Design", *IEEE Transactions on Applied Superconductivity,* Vol. 13, No. 2, June 2003, pp. 1365-1368, which describes analytics for a double helix magnet geometry. See, also, U.S. Pat. No. 6,921,042 incorporated herein by reference.

For helically wound conductors and other magnet geometries, some of these being racetrack and saddle configurations, placement of conductor has been problematic for multiple reasons. In conventional racetrack and saddle configurations, based on circular shaped-cable, the position of each wire turn has depended on the position of a previous wire turn. Such windings typically build on one another with a second row of turns being tightly wound over a previously wound row of turns. The windings are often generated with assistance of tooling that assures consistency as turns in each row are wound tightly against one another and as turns in consecutive rows are created one over the other. This tight stacking of turns has provided a means to stabilize the conductor. Further, this type of configuration often results in contact between turns in the same row as well as between turns in adjoining rows, and has required insulative coating on the conductor surface so that portions of the conductor coming into contact with other portions of the conductor are insulated from one another. To assure stability of the winding under high field conditions the turns are commonly bonded to one another with, for example, an adhesive.

In these prior systems the position and stability of the conductor has depended on the positioning of each conductor turn against another conductor turn and the ability to maintain the conductor in a static position during manufacture, assembly, and operation, i.e, under typical thermal cycling and high Lorentz forces acting during coil excitation. While the required tight nesting of turns of insulated wire without intervening layers can stabilize the conductor, the design of the wiring pattern has been limited and, thus, variation in design of the field pattern has also been limited. As shown in the illustrated embodiments, it is now possible to more fully utilize other wiring patterns, without compromising reliability, by separating all of the rows of conductor segments with intervening insulative layers and pre-defining the wiring patterns with channels formed in the insulative layers. Such techniques are more fully described in co-pending U.S. application Ser. No. 12/061,813 "Wiring Assembly and Method of Forming A Channel In A Wiring Assembly For Receiving Conductor" filed Apr. 3, 2008, now incorporated herein by reference.

Formation of channels into which the conductor is inserted provides precise conductor positioning and stabilization while also isolating portions of the conductor from other portions of the conductor. The channel profile is not limited to accommodating round wire or cables. Other conductor shapes such as square or rectangular cross sections or tape can be used in conjunction with channels. The channel may be configured to match the cross sectional shape of the conductor. The conductor pattern and the corresponding channel path can be formed in a relatively tight helical configuration wherein h, the advance per turn in an axial direction, is so small that portions of the conductor in adjacent turns come very close or into contact with one another. In embodiments where contact between adjacent portions of conductor turns is a concern, the conductor has an insulative coating.

The channels can accommodate circular, square or rectangular cross sectional shapes of conductor, including tape. To minimize deformation in conductor having a rectangular cross sectional shape, e.g., twisting, a helical channel can be formed at a variable angle with respect to a central axis or reference surface. In such embodiments, the resulting field will differ from that which is generated for a conventional conductor of circular cross sectional shape. A channel for a circular shaped conductor will not follow the same path as a channel formed at such variable angle to accommodate a rectangular shaped conductor without shape deformation.

The term "conductor" as used herein refers to a string-like piece or filament of relatively rigid or flexible material, commonly referred to as cable or wire, being of the type comprising either a single conductive strand or multiple ones of such strands grouped together as one functional conductive path. The term multi-strand conductor refers to such a conductor formed as a single identifiable unit and composed of multiple conductive strands which may be twisted, woven, braided or intertwined with one another to form an identifiable single unit of wire. Multi-strand conductor may take the form of conductor that embodies a circular or a non-circular cross section.

The term cross section refers to a section of a feature, e.g., of a conductor or an aperture or a coil, taken along a plane which is transverse to a definable axis through which the feature extends. If the coil row axis is curvilinear about a point of interest on the axis, the plane along which the cross section is taken is understood to be transverse to the direction of a vector which is tangent to the direction of the axis at the point of interest.

As used herein, the term coil and the adjective helical are not limited to regular helical patterns of conductor. A simple prior art spiral pattern in three-dimensional space, shown in the perspective view of FIG. 1A and the elevation view of FIG. 1B, is generated in accord with the relationships 1A, 1B and 1C:

$$X(\theta)=[h/(2*\pi)]\theta \quad 1A$$

$$Y(\theta)=R\cos(\theta) \quad 1B$$

$$Z(\theta)=R\sin(\theta) \quad 1C$$

wherein the X coordinate is along a longitudinal direction parallel with an axis of symmetry and the Y and Z coordinates are along directions transverse to the axis of symmetry and orthogonal to one another. θ is the azimuthal angle measured in a Y-Z plane transverse to the X-axis. The parameter h defines the advance per turn in the X direction. R is the radius of the aperture of the winding pattern. That is, for embodiments having a regular shape, R corresponds to a radial distance from an axis of symmetry to a point on the curve, and the aperture is the volume within the shape formed by the helical pattern.

FIGS. 2 and 3 are exemplary three-dimensional space curves illustrating features of prior art coils found in double helix coil pairs. For purposes of clarity, FIGS. 2 and 3 each illustrate a single coil row. These rows correspond to regular helical geometries generated in accord with the relationships 2A, 2B and 2C:

$$X(\theta)=[h/(2*\pi)]\theta+A_n\sin(n\theta) \quad 2A$$

$$Y(\theta)=R\cos(\theta) \quad 2B$$

$$Z(\theta)=R\sin(\theta). \quad 2C$$

The curve for n=1 is shown in the perspective view of FIG. 2. The curve for n=2 is shown in the perspective view of FIG. 3.

The term $A_n\sin(n\theta)$, in the X(θ) equation, imparts a positive or a negative tilt to each of the turns relative to the Y-Z plane, in proportion to the magnitude and sign of the term $A_n$. According to the value of n, the term $A_n\sin(n\theta)$ also introduces a modulation, i.e., a sinusoidal variation, in each 360 degree turn of the curve about the axis. For n=1, an ellipsoidal shape is imparted to each turn as shown in FIG. 2. The more complex pattern shown in FIG. 3, having a higher order sinusoidal component (n=2), is suitable for generating a quadrupole field. For higher values of n, still higher frequency sinusoidal components modulate the shape of each turn.

As can be seen from FIG. 2, with addition of the $A_n\sin(n\theta)$ term and with n=1, the turns are tilted relative to the YZ-plane. This results in a significant component of current flow in the axial direction. A transverse magnetic field is therefore generated together with an axial field component. With incorporation of a second layer of turns (as shown in FIG. 4, again with n=1), and with the two patterns having opposite tilt angles relative to the YZ-plane (by providing the terms $A_n$ in each of the two coils with opposite signs), it is possible to generate a substantially pure transverse field and practically eliminate the axial field component. This and other pairs of coil patterns having opposite tilts, i.e., for differing values of n, are referred to in the literature as double-helix windings.

Still, more generally, in accord with several embodiments of the invention, a three-dimensional space curve may be generated in accord with the equations 3A, 3B and 3C:

$$X(\theta)=[h/(2*\pi)]\theta+\Sigma A_n\sin(n\theta+\phi_n) \quad 3A$$

$$Y(\theta)=R\cos(\theta) \quad 3B$$

$$Z(\theta)=R\sin(\theta) \quad 3C$$

wherein $A_n$ determines the amplitudes in equation 3A, and $\phi_n$ determines phase shifts between the sinusoidal components. R determines the radius of the winding pattern, which is measured from the axis of the cylindrically shaped coil and θ is the azimuth angle In this context the term coil and the adjective helix refer to a variety of spiral-like shapes which can result from the aforedescribed function, understanding that other trigonometric or numerical expressions may be used to define the channel path and the conductor path. The individual or combined content of the fields corresponding to one or more values of n are generally referred to as multipole moments. Field components generated from a double-helix winding configuration, and corresponding to different values of n according to equation 3 are substantially or entirely orthogonal with one another.

An individual layer of a double-helix coil simultaneously generates transverse and axial magnetic fields. Transverse in this context describes magnetic fields having Y and Z components. In most applications the current directions in individual layers of double-helix coils are chosen in such a way that the transverse magnetic fields of layers add up, while the axial fields are canceled to a high degree. It is therefore customary to describe the magnetic field by two dimensional multipoles in the transverse plane. If the field changes along the X-direction, e.g. as is the case near the coil ends, a two dimensional multipole expansion can still be used to describe the field, and the multipole contents for different axial positions are determined. In accord with equation 3A, the multipole field components that can be generated with the resulting coil pattern correspond to the values of n for which each $A_n$ is nonzero in equation 3A.

In a long winding configuration, where coil end effects can be neglected, the pattern for n=1 will generate an essentially pure dipole field having no higher order components. Similarly, a quadrupole pattern (n=2), a sextupole pattern (n=3) and other higher order patterns generate pure fields with a multipole order defined by the value of n.

Theoretically, magnetic fields of almost arbitrary shape and quality can be generated in accord with the above mathematics. However, construction of coils for generating fields with higher multipole order (n>1) or fields containing more than one multipole order, e.g., superimposed dipole plus quadrupole fields, is limited by geometrical constraints, such as requiring a minimum spacing between conductors to avoid conductor impingement. The conductor spacing in a coil is controlled by the term, h, in equation 3A. For increasing values of h the conductors are spaced further apart along the X-direction. The minimum conductor spacing corresponds to when adjacent conductors just touch each other. Any further decrease in conductor spacing would lead to interference between neighboring conductors.

FIG. 5 presents a 360 degree view of the quadrupole coil pattern shown in FIG. 3. This and other 360 views of coil patterns shown in FIGS. 6 and 7 are transforms from views of three dimensional contours such as the cylindrical-like configuration of FIG. 3, to views in a plane, referred to herein as "unrolled" views. That is, these views are generated as though the three dimensional shaped surface is cut open and layed along a plane to provide a two dimensional or plan view in which the abscissa represents the arc length over the cylinder surface and the ordinate represents the axial direction.

The minimum required conductor spacing can be illustrated in an unrolled view of the winding pattern, where the X-coordinate is plotted against the circumference U, which is given by the radius R times the azimuth angle, θ). As shown in FIG. 5, the local slope of the conductor direction is dX/dU=tan(α) where α is the angle of the conductor trajectory, relative to a plane transverse with the axis, at any circumference value U or equivalently any azimuth angle θ. The minimum possible wire spacing without impingement is given as follows by equations 4A and 4B:

$$\tan(\alpha)=dX/dU=(1/R)(dX/d\theta) \quad 4A$$

$$\text{minimum spacing}=d/\cos(\alpha_{max}), \quad 4B$$

where d is the conductor width and $\alpha_{max}$ is the maximum slope angle incurred along the trajectory. As can be seen from equation 4B, the minimum spacing is determined by the largest slope angle α in the coil winding. See FIG. 5 for an illustration of the slope angle α. Also, as illustrated in FIGS. 5, 6 and 7, the illustrated wiring patterns are a continuous series of segments 2. Along first portions 4 of the segments, individual segments are relatively straight and along second portions 6 of the segments the segments follow a contour having a definable radius of curvature.

Larger slope angles require larger conductor spacings in a winding pattern and thereby lower the achievable magnetic field strength of the resulting coil configuration. This is because fewer conductor turns can be applied per unit distance along the X axis. Many applications require relatively high field strengths and it may be desirable to achieve the minimum possible conductor spacing (i.e., with the conductor surfaces having an insulative coating enabling surfaces to touch one another) as defined in equation 4B. Since the higher-order multipole winding configurations have more sinusoidal oscillations per conductor turn (see equation 3A), the slope angles α generally increase with increasing multipole order content.

The minimum possible conductor spacing in combined function magnets is also affected by the phase angles $\phi_n$. See equation 3A. Qualitatively this can be understood for superimposed dipole and quadrupole fields according to $$X(\theta)=[h/(2*\pi)]\theta+A_1\sin(\theta)+A_2\sin(2\theta+\Delta\phi) \quad 5A$$

For Δφ=0, minima and maxima of the dipole component coincide with minima and maxima of the quadrupole component, while for a Δφ≠0 the peak values of the component sinusoidal functions are displaced. For example, referring to Equation 3A, with $\phi_i$ not equal to $\phi_j$ the peak values of the component sinusoidal functions are displaced relative to each other. The effect of this can best be seen in the unrolled view in FIGS. 6 and 7 wherein the quadrupole amplitude $A_2$ is selected to be half the dipole amplitude $A_1$. The phase shift Δφ is zero in FIG. 6 and is 90 degrees in FIG. 7. That is, the assembly 8, represented schematically according to the unrolled view of FIG. 7, provides a combined function magnet with the pattern for generating multipole orders i and j being formed with $\phi_j-\phi_i=90$ degrees. The conductor spacing, h, for each case is set to the required minimum value.

A feature of the invention is that the maximum value of the slope angle α, referred to as $\alpha_{max}$, is a function of the relative phase shift between components of different orders, n, and this can lead to a decrease of the maximum slope angle $\alpha_{max}$ thereby reducing the minimum achievable conductor spacing h and increasing overall conductor density along the axis. This enhances the magnetic field density. For the given example with $A_2$ equal to one half $A_1$, the minimum achievable conductor spacing can be reduced by about ten percent. Increasing the conductor density increases the magnetic transfer function, thereby increasing the field magnitude per unit of current. More generally, useful improvements in the transfer function can be realized in combined function assemblies where, for individual coil rows, X(θ) includes at least the following terms:

$$[h/(2*\pi)]\theta+A_i\sin(\theta)+A_j\sin(j\theta+\Delta\phi)+\ldots$$

In example embodiments, $A_i$ is at least ten percent of $A_j$.

While the invention has been described with reference to particular embodiments, it will be understood by those skilled in the art that various changes may be made and equivalents may be substituted for elements thereof without departing from the scope of the invention. For example, although the coil 10 has been shown to be symmetric about a straight axis, numerous ones of the disclosed features can be advantageously applied in other applications such as wherein the axis is curvilinear or generally asymmetric.

The claimed invention is:

1. A method for constructing a conductor assembly of the type formed of one or more coil rows which, when conducting current, generate a magnetic field or in which, in the presence of a changing magnetic field, a voltage is induced, comprising:

forming a conductor pattern in a first coil row according to the relationship $$X(\theta)=[h/(2*\pi)]\theta+\Sigma A_n\sin(n\theta+\phi_n)$$

$$Y(\theta)=R\cos(\theta)$$

$$Z(\theta)=R\sin(\theta),$$

the first coil row pattern suitable for simultaneously generating at least two multipole orthogonal field components of different orders, wherein:

X is measurable along an X axis, Y is measurable along a Y axis and Z is measurable along a Z axis, the coil row extends along the X axis, the coil row is formed with a conductor configured in a series of turns about the X axis creating spaced-apart segments of the conductor such that, along first portions of the segments, individual segments are relatively straight and along second portions of the segments the segments follow a contour having a definable radius of curvature, the series of turns providing a geometrical configuration for generating a first multipole component of order n=i with $A_n=A_i$ and $\phi_n=\phi_i$ and a second multipole component of order n=j with $A_n=A_j$ and $\phi_n=\phi_j$ with $\phi_i$ not equal to $\phi_j$.

2. The method of claim 1 wherein components of the conductor path which correspond to providing the first multipole component contribute to have a primary influence on turn spacing between segments at a first angle $\theta=\phi_i$ and components of the conductor path which correspond to providing the second multipole component contribute to have a primary influence on reducing turn spacing between segments at a second angle $\theta=\phi_j$.

3. The method of claim 1 wherein $\phi_i-\phi_j=90$ degrees.

4. The method of claim 1 wherein the first component corresponds to n=1 and the second component corresponds to n=2.

5. The method of claim 1 wherein the assembly exhibits a transfer function measurable as a function of field magnitude per unit of current passing through the assembly and the transfer function of at least the first coil row is greater than that achievable for $\phi_i=\phi_j$.

6. The method of claim 5 wherein the transfer function of at least the first coil row is ten percent greater than that achievable for $\phi_i=\phi_j$.

7. The method of claim 1 wherein $X(\theta)$ includes $A_i \sin(i\theta+\phi_i)+A_j \sin(j\theta+\phi_j)$ and $A_i$ is at least 10 percent the value of $A_j$.

8. A conductor assembly of the type formed of one or more coil rows which, when conducting current, generate a magnetic field or in which, in the presence of a changing magnetic field, a voltage is induced, comprising:

a first coil row having a conductor pattern according to the relationship $$X(\theta)=[h/(2*\pi)]\theta+\Sigma A_n \sin(n\theta+\phi_n)$$

$$Y(\theta)=R \cos(\theta)$$

$$Z(\theta)=R \sin(\theta),$$

the first coil row pattern suitable for simultaneously generating at least two multipole orthogonal field components of different orders, wherein:

X is measurable along an X axis, Y is measurable along a Y axis and Z is measurable along a Z axis, the coil row extends along and about the X axis, and the coil row is formed with a conductor configured in a series of turns about the X axis creating spaced-apart segments of the conductor such that, along first portions of the segments, individual segments are relatively straight and along second portions of the segments the segments follow a contour having a definable radius of curvature, the series of turns providing a geometrical configuration for generating a first multipole component of order n=i with $A_n=A_i$ and $\phi_n=\phi_i$ and a second multipole component of order n=j with $A_n=A_j$ and $\phi_n=\phi_j$ with $\phi_i$ not equal to $\phi_j$.

* * * * *